US011656064B2

(12) United States Patent
Brodie et al.

(10) Patent No.: US 11,656,064 B2
(45) Date of Patent: May 23, 2023

(54) BROADHEAD

(71) Applicant: Annihilator Broadheads, LLC, Eagle, ID (US)

(72) Inventors: Brandon Brodie, Eagle, ID (US); Micah Brown, Auburn, CA (US)

(73) Assignee: ANNIHILATOR BROADHEADS, LLC, Eagle, ID (US)

( * ) Notice: Subject to any disclaimer, the term of this patent is extended or adjusted under 35 U.S.C. 154(b) by 0 days.

(21) Appl. No.: 17/231,943

(22) Filed: Apr. 15, 2021

(65) Prior Publication Data

US 2021/0348896 A1 Nov. 11, 2021

Related U.S. Application Data

(63) Continuation of application No. 16/436,978, filed on Jun. 11, 2019, now Pat. No. 11,002,521.

(60) Provisional application No. 62/714,036, filed on Aug. 2, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/583
See application file for complete search history.

(56) References Cited

U.S. PATENT DOCUMENTS 2,888,264 A * 5/1959 Sharrar ..... F42B 6/08 473/585
4,234,191 A * 11/1980 Erlandson ..... F42B 6/08 473/583
4,676,512 A * 6/1987 Simo ..... F42B 6/08 473/584
5,064,202 A * 11/1991 Barner ..... F42B 6/08 473/583
5,143,380 A * 9/1992 Maleski ..... F42B 6/08 473/584
6,077,179 A * 6/2000 Liechty, II ..... F42B 6/08 473/582
6,283,880 B1 * 9/2001 Barrie ..... F42B 6/08 473/584

(Continued)

OTHER PUBLICATIONS

U.S. Non Final Office Action in U.S. Appl. No. 16/436,978, dated Nov. 4, 2020, 14 pages.

(Continued)

*Primary Examiner* — Alexander R Niconovich
(74) *Attorney, Agent, or Firm* — Workman Nydegger

(57) ABSTRACT

The present disclosure describes a broadhead for an arrow. The broadhead includes a first portion, as defined along a longitudinal axis of the broadhead. The first portion includes multiple cutting walls that extend radially from the longitudinal axis and define a first plurality of voids between the cutting walls. The outer edges of the cutting walls form edges of a generally pyramid-shaped volume that includes the first portion and the first plurality of voids. The broadhead also includes a second portion that abuts the first portion. The second portion includes multiple concave lopes defining a second plurality of voids. The concave lobes have an inner surface that extends radially outward from the first end along the longitudinal axis to an opposite, second end of the second portion.

20 Claims, 5 Drawing Sheets

(56) References Cited

U.S. PATENT DOCUMENTS

| | | | | |
|---|---|---|---|---|
| 6,290,903 | B1 * | 9/2001 | Grace, Jr. | B22F 5/00 419/36 |
| 6,863,630 | B1 * | 3/2005 | Watkins | F42B 6/08 473/583 |
| 6,997,827 | B1 * | 2/2006 | Grace, Jr. | F42B 6/08 473/583 |
| 7,011,589 | B2 * | 3/2006 | Davis | F42B 6/08 473/584 |
| 7,025,697 | B2 * | 4/2006 | Mizek | F42B 6/08 473/583 |
| 7,234,220 | B1 * | 6/2007 | Grace, Jr. | F42B 6/08 29/434 |
| 7,314,419 | B2 * | 1/2008 | Grace | F42B 6/08 473/583 |
| 8,043,178 | B2 * | 10/2011 | Sames | F42B 6/08 473/583 |
| 8,096,905 | B1 * | 1/2012 | Gillig | F42B 6/08 473/584 |
| 8,105,188 | B1 * | 1/2012 | Mercer | F42B 6/08 473/583 |
| 8,167,748 | B2 * | 5/2012 | Butcher | F42B 6/08 473/583 |
| 8,210,971 | B1 * | 7/2012 | Fulton | F42B 6/08 473/583 |
| 8,496,549 | B2 * | 7/2013 | Couture | F42B 6/08 473/583 |
| 8,771,113 | B2 * | 7/2014 | Patton | F42B 6/08 473/583 |
| 8,920,269 | B2 * | 12/2014 | Rager | F42B 6/08 473/583 |
| 9,022,886 | B2 * | 5/2015 | Faller | F42B 6/08 473/582 |
| 9,239,216 | B2 * | 1/2016 | Hartcraft | F42B 6/08 |
| 9,772,170 | B1 * | 9/2017 | Lathrop | F16F 1/10 |
| 10,066,912 | B2 * | 9/2018 | Grace | A63B 69/00 |
| 10,197,368 | B2 * | 2/2019 | Lathrop | F42B 6/08 |
| 10,690,461 | B2 * | 6/2020 | Huntsman | F42B 6/08 |
| 2007/0243959 | A1 * | 10/2007 | Grace | F42B 6/08 473/583 |
| 2015/0168110 | A1 * | 6/2015 | Hartcraft | F42B 6/08 473/583 |
| 2018/0188011 | A1 * | 7/2018 | Grace | F42B 6/08 |

OTHER PUBLICATIONS

U.S. Notice of Allowance in U.S. Appl. No. 16/436,978, dated Feb. 12, 2021, 12 pages.

* cited by examiner

BROADHEAD

BACKGROUND

When hunting with a bow, a hunter attempts to make an arrow accurately hit and efficiently travel through a vital region of a target animal. However, a common problem for hunters is that animals, particularly big game, can travel several miles before expiring from a lethal arrow wound. This means that to harvest the animal, the hunter may be required to track and locate the animal over a long distance.

When tracking the animal, a hunter searches for signs such as blood trails from the animal. However, the animal's body may naturally reduce an amount of blood loss after the lethal shot, which can make it difficult or impossible to track the animal based on blood trails. Many times, this results in a loss of the animal.

A broadhead is an arrow component disposed at a forward tip of the arrow. The broadhead generally has a cross-section that extends wider (a distance orthogonal to a longitudinal axis of the arrow), than a shaft of the arrow. An advantage of using a broadhead includes an increased wound channel within a successfully hit target animal, which in turn increases an amount of blood loss and an amount of damage done to the target animal. This increased wound channel leads to improved tracking of the animal and a faster and more humane expiration for the animal.

When designing a broadhead, a manufacturer considers features such as a cutting diameter of the broadhead (e.g., an effective size of a wound channel), how the broadhead affects proper and consistent flight from a bow to a target, penetration abilities of the broadhead, and durability of the broadhead. A broadhead that improves upon one of more of these features would provide a hunter with a better hunting experience by improving tracking of a target animal and may provide a more humane harvest of the target animal by accelerating expiration of the animal.

This Background introduces a selection of concepts in a simplified form that are further described below. This Background is not an admission of prior art and should not be considered as such.

SUMMARY

This disclosure incorporates by reference provisional application No. U.S. 62/714,036 filed on Aug. 2, 2018. This disclosure describes a broadhead that is designed for increased internal hemorrhaging and external blood seepage of a target animal. The described broadhead may improve, or minimally affect, arrow flight and accuracy. Additionally, the broadhead may be formed as a single piece and without moving parts to avoid structural vulnerabilities and reduce variations in manufacturing and flight performance. Any reference herein to an "arrow" is intended to include an archery arrow, a crossbow bolt, and a crossbow arrow. Furthermore, the broadhead described herein may be used in any type of ballistic.

In an example embodiment, a broadhead includes a first portion, as defined along a longitudinal axis of the broadhead. The first portion includes multiple cutting walls that extend radially (outwardly) from the longitudinal axis and define a first plurality of voids between the cutting walls. The outer edges of the cutting walls form edges of a generally pyramid-shaped volume that includes the first portion and the first plurality of voids. In other words, the outer edges of the cutting walls form a portion of a wireframe of the pyramid shape, not including edges of a base of the generally pyramid-shaped volume. The broadhead also includes a second portion, as defined along the longitudinal axis, that abuts the first portion. The second portion includes multiple concave lobes defining a second plurality of voids. The concave lobes have an inner surface that extends radially outward from the first end along the longitudinal axis to an opposite, second end of the second portion.

In another example embodiment, a broadhead includes a plurality of cutting walls extending radially from a longitudinal axis. The plurality of cutting walls form edges of a generally pyramid-shaped volume and define a first plurality of voids between the cutting walls. The broadhead also includes a plurality of concave lobes defining a second plurality of voids. Respective edges of the plurality of lobes extend between two of the plurality of cutting walls. In some implementations, the edges of the lobes form an arc that curves toward a rearward end of the broadhead.

In another example embodiment, a broadhead includes a plurality of cutting walls extending from a chisel point and forming edges of a generally pyramid-shaped volume, with the chisel point being a top of the generally pyramid-shaped volume. The plurality of cutting walls define a first plurality of voids between the cutting walls. The broadhead also includes a plurality of concave lobes that define a second plurality of voids that are in communication with the first plurality of voids. The plurality of concave lobes have respective edges extending between two of the plurality of cutting walls to form respective outer edges of the concave lobes.

This Summary introduces a selection of concepts in a simplified form that are further described below in the Detailed Description. As such, this Summary is not intended to identify essential features of the claimed subject matter, nor is it intended to be used to narrow the scope of the claimed subject matter. One or more of the described features may be included in an implementation of a broadhead.

BRIEF DESCRIPTION OF THE DRAWINGS

The detailed description is described with reference to the accompanying figures. Entities represented in the figures may be indicative of one or more entities and thus reference may be made interchangeably to single or plural forms of the entities in the discussion.

DETAILED DESCRIPTION

Overview

Figure 1:
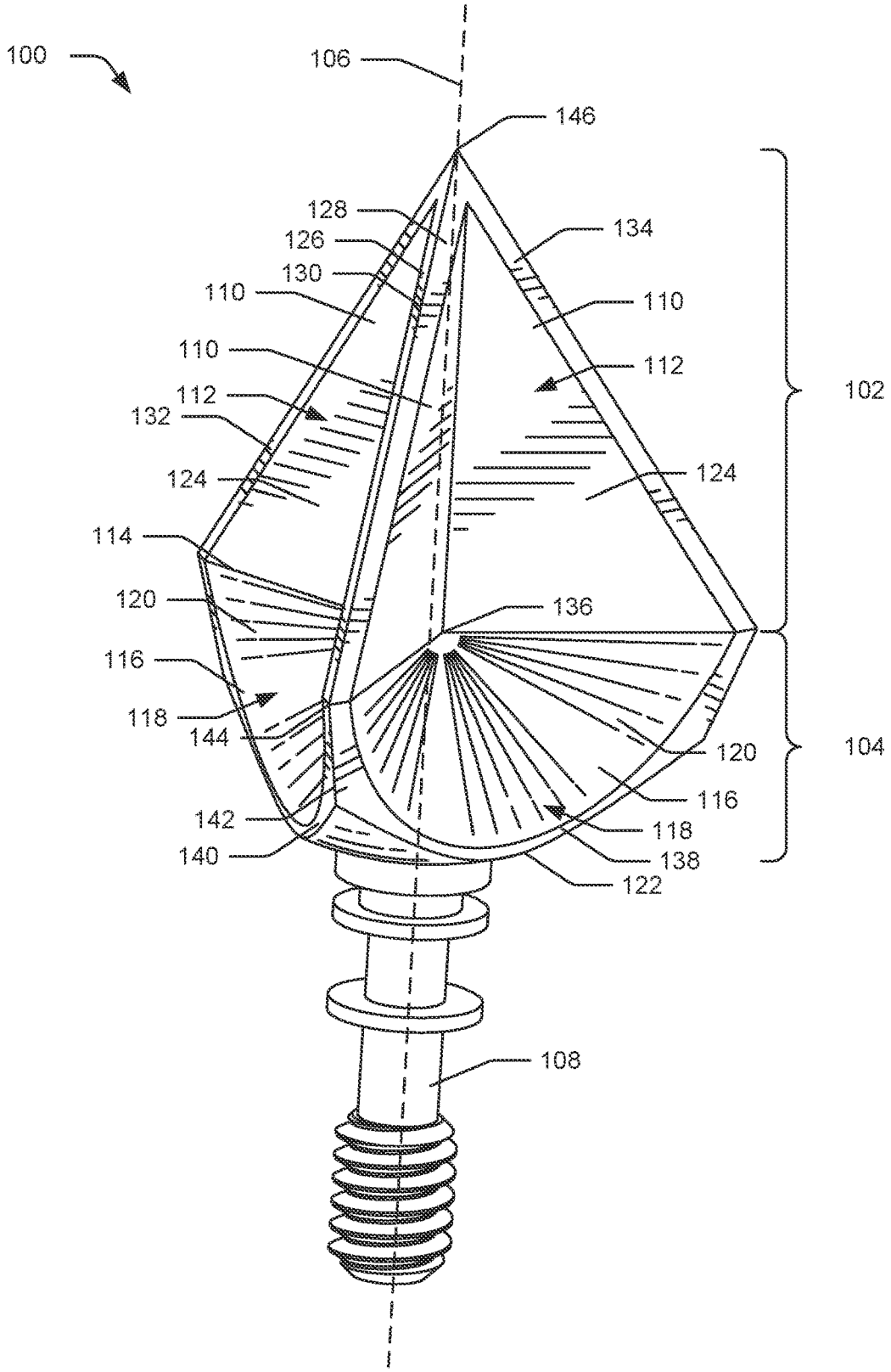
FIG. 1 is a perspective view of an example broadhead.
Figure 2:
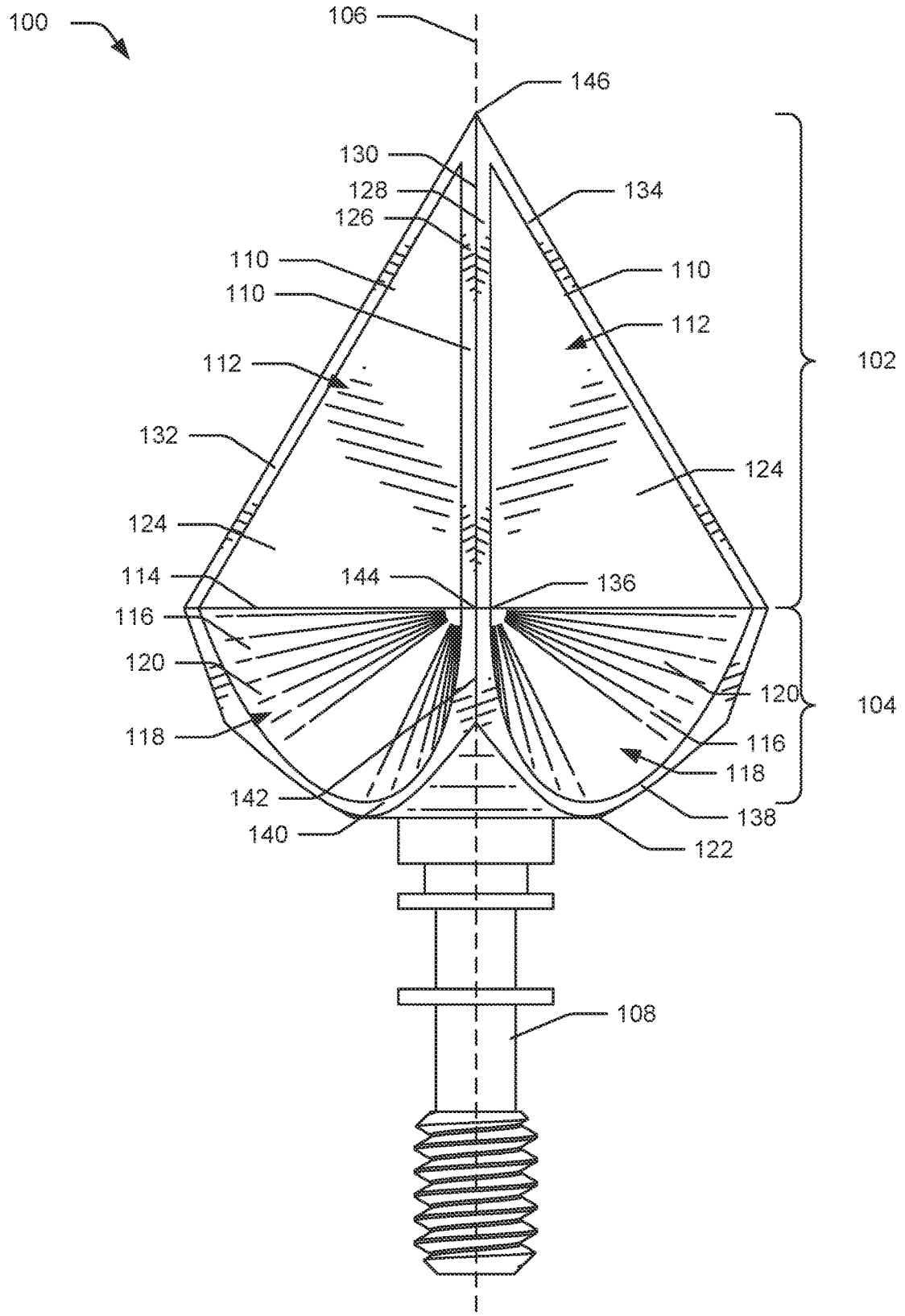
FIG. 2 is a side view of the example broadhead of FIG. 1.
Figure 3:
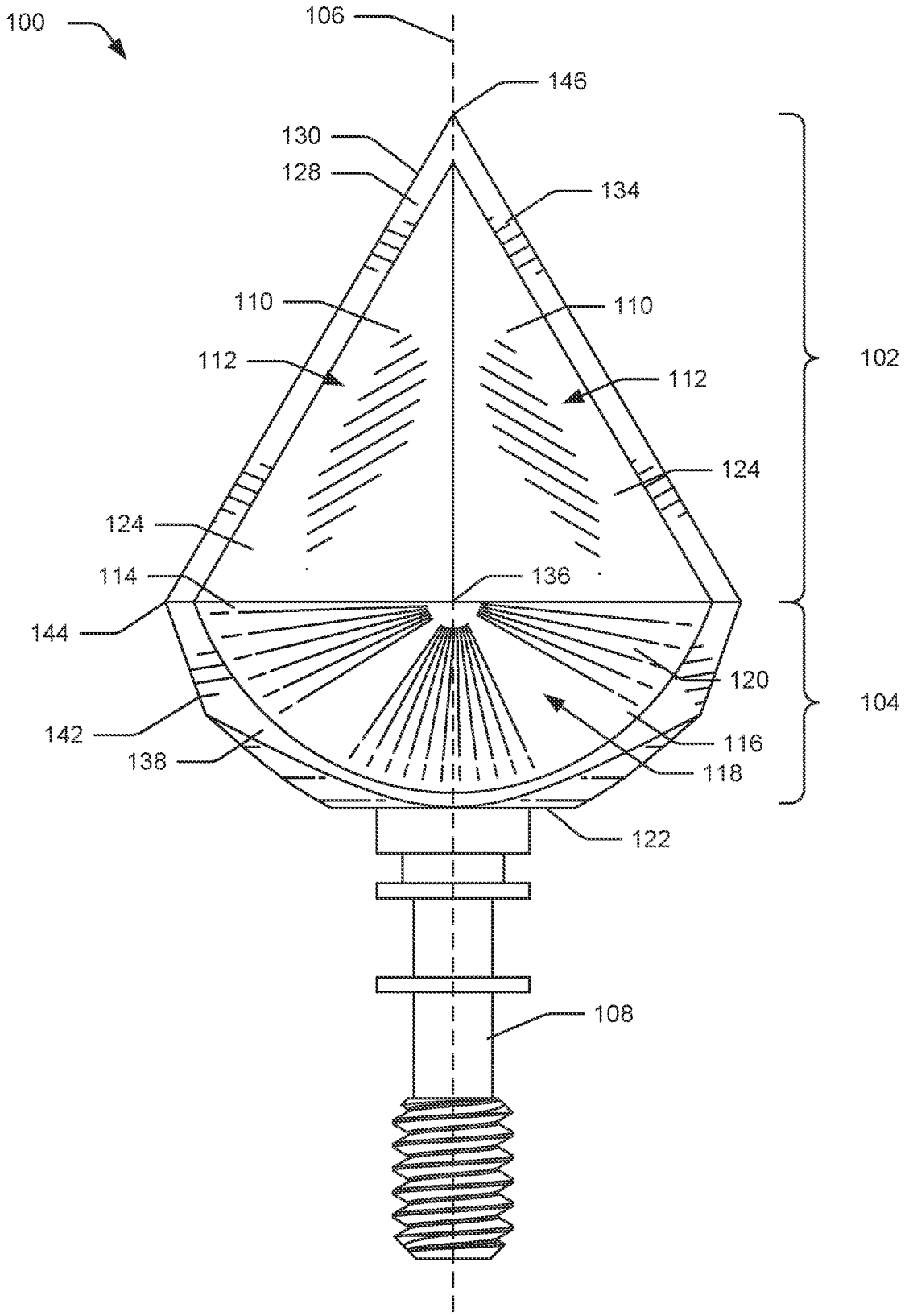
FIG. 3 is another side view of the example broadhead of FIG. 1.
Figure 4:
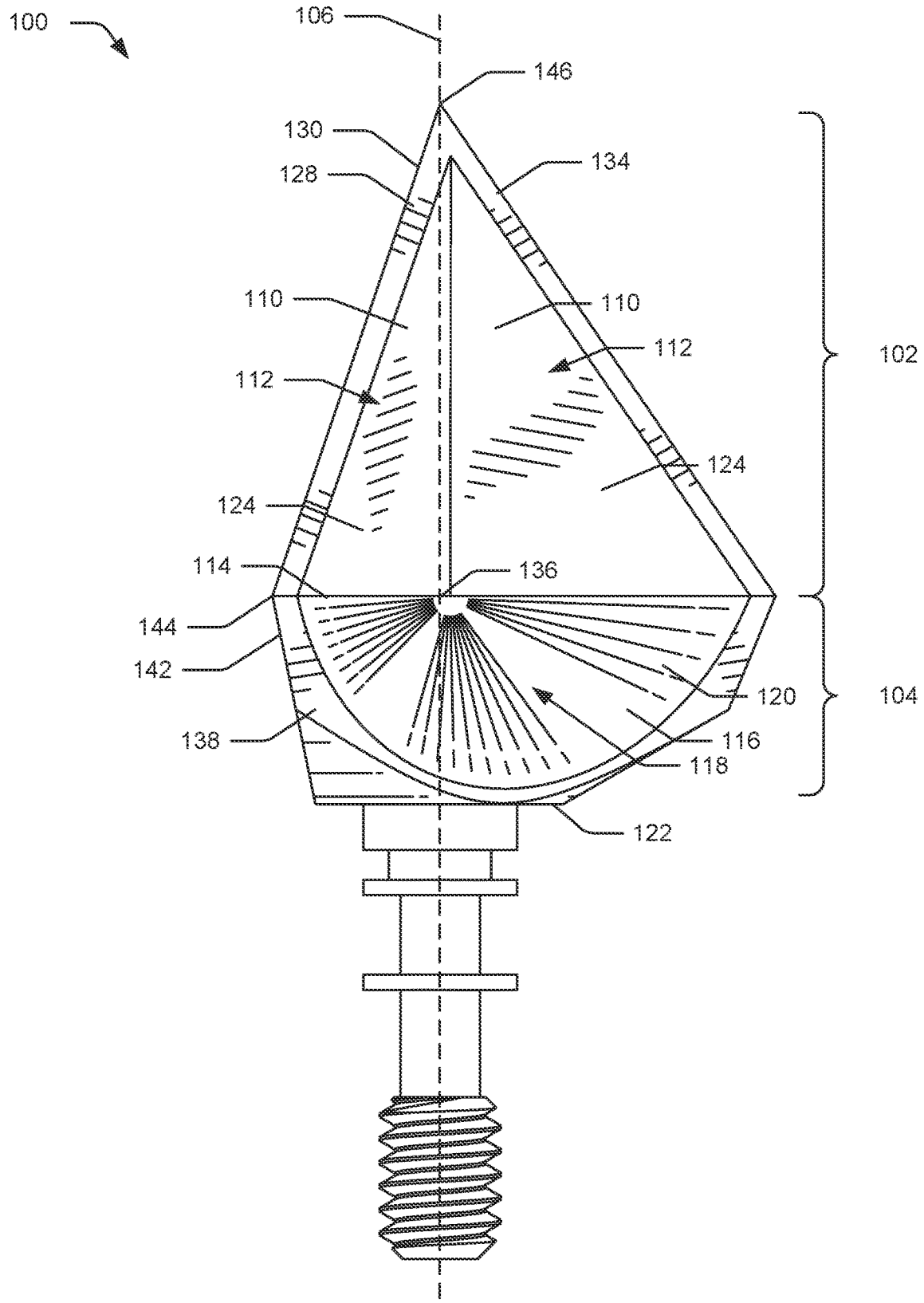
FIG. 4 is another side view of the example broadhead of FIG. 1.

The described embodiments of broadheads improve upon conventional broadheads. The design features of the described embodiments result in a broadhead that causes an increased wound channel in a target animal by scooping flesh of the target animal away from a longitudinal axis of the broadhead as the broadhead travels through the target animal By increasing the wound channel, the target animal loses blood more quickly, which can accelerate the expiration process and improve tracking of the animal.

In a particular embodiment, the broadhead has a forward-most end formed into a chisel point. Three triangular-shaped cutting walls extend rearward and radially outward from the chisel point. The cutting walls define voids between one another that are shaped as triangular prisms. Each of the cutting walls has an outer edge that functions as a forward attack cutting edge to assist the broadhead with penetrating through animal mass. At a rearward end, the outer edges of the cutting walls meet respective rear attack cutting edges at respective attack points, which define outermost points of the broadhead. The rear attack cutting edges form at least a portion of an edge of a respective concave lobe. The concave lobes define another set of voids that are in communication with the void between the cutting walls. Each concave lobe, respectively, forms an outer surface of a cone, a sphere, an ellipsoid, or a paraboloid extending radially outwardly from a longitudinal axis of the broadhead. The voids between the cutting walls and the other set of voids are symmetric about a plane that intersects a longitudinal axis of the broadhead. The broadhead further includes a post to couple the broadhead to an arrow.

Example Implementation

FIGS. 1-6 illustrate an example implementation of a broadhead 100. The broadhead 100 includes a first portion 102 and a second portion 104, as defined along a longitudinal axis 106. The broadhead may also include a post 108 for coupling the broadhead 100 to an arrow shaft. The broadhead 100 may be formed as a single piece of material such that the first portion 102 and the second portion 104, and optionally the post 108, are integrally coupled. For example, the first and second portions 102, 104 can be formed from a common substrate. In some of these embodiments, the broadhead 100 is free from seams or joints between the first portion 102 and the second portion 104. The broadhead 100 may be formed via a casting process using a mold or may be formed via removing a portion of material from a block of material. The broadhead 100 may, for example, comprise one or more of steel, stainless steel, titanium, high-carbon metal, graphene, carbon steel, tungsten carbide, iron, chromium. The broadhead 100 may also be chemically treated to resist oxidation, which may include enveloping the broadhead 100 in a film.

The first portion 102 may comprise a plurality of cutting walls 110 that extend radially from the longitudinal axis 106. The broadhead 100 may include 2, 3, 4, 5, 6, 7, or more cutting walls 110. The cutting walls 110 define respective ones of a plurality of voids 112 between the cutting walls 110. In some embodiments, some or all of the voids 112 are substantially shaped as a triangular prism (e.g., pyramidal volume), as in the embodiment of the broadhead 100 shown. The plurality of cutting walls 110 may form edges of a generally pyramid-shaped volume that includes the plurality of voids 112.

The second portion 104 may have a first end 114 abutting the first portion 102. The second portion 104 may comprise a plurality of concave lobes 116 that define another plurality of voids 118. The plurality of concave lobes 116 may each have an inner surface 120 that extends radially outward from the first end 114 along the longitudinal axis 106 to an opposite, second end 122 of the second portion 104. In other words, the concave lobes 116 may have a radial thickness that is relatively small at the first end 114 and a radial thickness that is relatively large proximate to the second end 122.

The cutting walls 110 may include two opposite surfaces 124 (or "inner surfaces") in contact with to the voids 112. The inner surfaces 124 may be generally planar and may define a surface of a respective one of the voids 112. In some embodiments, two opposite surfaces 124 of a same cutting wall 110 are parallel and/or symmetric surfaces (or planes). Additionally or alternatively, one or more of the inner surfaces 124 may be parallel to a radius extending from the longitudinal axis along the cutting wall 110. Further, the cutting walls 110 may have a substantially uniform width a width that is substantially uniform over a majority of the length of the cutting wall 110.

In some embodiments, one or more of the cutting walls 110 includes two radially outer surfaces 126, 128 that intersect at a forward attack cutting edge 130. One or both of the radially outer surfaces 126, 128 can be coplanar with a corresponding radially outer surface 132, 134 of another one of the cutting walls 110. In some embodiments, each cutting wall 110 includes two radially outer surfaces 126, 128 that intersect at a forward attack cutting edge 130 and each radially outer surface 126, 128 is coplanar with a corresponding radially outer surface 132, 134 of another cutting wall 110. In such embodiments, a sharpening stone may be used to simultaneously sharpen one side of a forward attack cutting edge 130 of one cutting wall 110 and one side of a forward attack cutting edge 130 of another cutting wall 110.

A portion of an inner surface 124 of a respective cutting wall 110 that abuts the first end 114 of the second portion 104 may form a generally smooth interface with, or transition to, a corresponding abutting portion of the inner surface 120 of a respective concave lobe 116. In some embodiments, the abutting portion (at the first end 114) of the inner surface 120 of a concave lobe 116 meets two adjacent cutting walls 110 at an intersection 136.

In some embodiments of the broadhead 100, such as the one shown, the concave lobes 116 have outer edges 138 around and defining the concave inner surface 120 and the voids 118. The outer edges 138 may be generally planar such that the broadhead can rest on the outer edge 138. Respective upper ends of outer edges 138 can extend from outer edges of respective cutting walls 110. The outer edges 138 may further extend between two of the plurality of cutting walls 110. In some of these embodiments, the outer edges 138 form arcs that curve (with a generally forward concavity) toward the second end 122 of the second portion 104 (e.g., the rearward end of the broadhead 100) between adjacent cutting walls 110. Additionally, in such embodiments, the voids 112 and the voids 118 are in communication and form a combined void.

In some embodiments, the voids 112, 118 collectively make up about 40% of a volume consisting of the first portion 102, the second portion 104, and voids 112, 118. For example, the voids 112, 118 may make up between 35% and 45% of the volume. In other examples, the voids 112, 118 make up between 40% and 50% of the volume. Such a broadhead may be a 125 grain broadhead.

In some embodiments, the voids 112, 118 collectively make up about 57% of a volume consisting of the first portion 102, the second portion 104, and the voids 112, 118. For example, the void 112, 118 may make up between 52% and 62% of the volume. In other examples, the voids 112, 118 make up between 45% and 70% of the volume. Such a broadhead may be a 100 grain broadhead.

A concave lobe 116 may include an outer edge 138 that meets an outer edge 140 of an adjacent concave lobe 116 at a rear attack cutting edge 142. In embodiments where the outer edges 138, 140 are generally planar, one side of a rear attack cutting edge 142 can be sharpened (e.g., using a planar sharpening stone) simultaneously with sharpening one side of an adjacent rear attack cutting edge 142. The rear attack cutting edge 142 may meet the forward attack cutting edge 130 at an attack point 144, which may define an outermost point (radially) of the broadhead 100.

In some embodiments, some or all of the outer edges 138 of the concave lobes 116 form a wireframe of a portion of volume shaped generally as a sphere, cone, ellipsoid, or paraboloid. For example, the outer edges 138 may extend as longitude lines of the three-dimensional shape. These longitudinal lines may be generally triangular, as shown, with a base of the triangle at the second end 122 of the second portion 104 and a tip opposite the base extending toward the first end 114 of the second portion 104. Additionally or alternatively, the second end 122 of the second portion 104 may extend beyond the outer edges 138 of the concave lobes 116 in a longitudinal direction. The outer edges 138 of the concave lobes 116 may be the farthest extension of the broadhead 100 in a radial direction at any given angle from the longitudinal axis 106 (e.g., the outer edges 138 may define a largest width of the broadhead 100 at every angle from the longitudinal axis 106).

In some embodiments, some or each of the concave lobes 116 form a portion of an outer surface of a sphere, cone, ellipsoid, or paraboloid. In the case of a sphere, ellipsoid, or paraboloid, the concave lobe 116 is concave along at least two orthogonal axes.

The cutting walls 110 may be generally triangular with respective first points collectively forming a chisel point 146 of the broadhead 100, a respective second point abutting respective upper ends of an edge 138 of a respective concave lobe 116 to form the attack point 144, and a respective third point at a transition to an inner portion of the respective concave lobe (the intersection 136).

In some implementations, the broadhead 100 further includes a field tip abutting the first portion 102 on an end opposite the second portion 104. In other words, the field tip abuts the first portion 102 at a forward end and the second portion 104 abuts the first portion 102 at a rearward end of the first portion 102.

Figure 5:
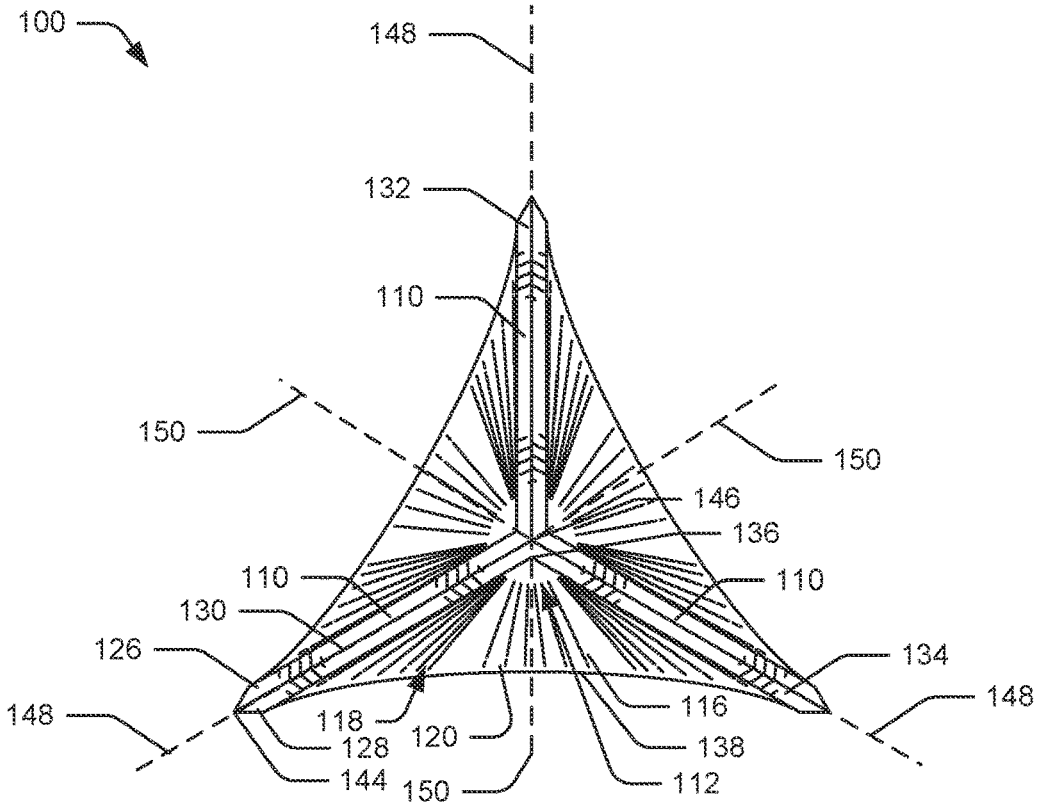
FIG. 5 is a top view of the example broadhead of FIG. 1.
Figure 6:
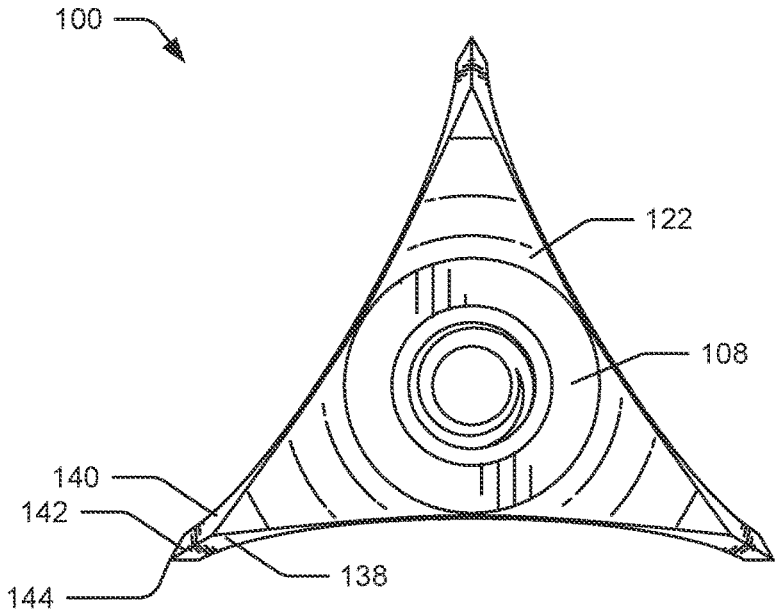
FIG. 6 is a bottom view of the example broadhead of FIG. 1.

FIG. 5 includes reference planes (e.g., longitudinal planes) 148, 150 that extend radially from, and/or are parallel to, the longitudinal axis. In some implementations, one or more of the concave lobes 116 (and a corresponding one of the voids 118) is symmetric about the reference plane 150. In other implementations, one or more of the concave lobes 116 includes an offset such that the concave lobe 116 is either asymmetric or is symmetric about a plane that has a non-zero angle (an angle between 0 and 180 degrees, excluding 0 and 180 degrees) with the longitudinal axis 106 of the broadhead 100. In some embodiments, the offset causes the concave lobe 116 to be formed as if the second end 122 is twisted from the first end 114.

Similarly, one or more of the voids 112 may be symmetric about a longitudinal plane 150, asymmetric, or symmetric about a plane that has a non-zero angle (an angle between, but not including, 0 degrees and 180 degrees) with the longitudinal axis 106 of the broadhead 100.

One or more of the cutting walls 110 may be symmetric about the reference plane 148. In some of these embodiments, the two opposite surfaces 124 are generally parallel and planar. In other implementations, one or more of the cutting walls 110 includes an offset such that the cutting wall 110 is either asymmetric or is symmetric about a plane that has a non-zero angle (an angle between 0 and 180 degrees, excluding 0 and 180 degrees) with the longitudinal axis 106 of the broadhead 100. In some embodiments, the offset causes the cutting wall 110 to be formed as if the chisel point 146 is twisted from the rearward-most portion of the cutting wall 110 abutting the first end 114 of the second portion 104.

For embodiments where one or both of the concave lobes 116 and the cutting walls 110 include an offset, the offset may be, for example, between 1 and 5 degrees, between 1 and 15 degrees, or between 1 and 30 degrees.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

The invention claimed is:

1. A broadhead comprising:

a first portion along a longitudinal axis of the broadhead, the first portion comprising a plurality of cutting walls extending radially from the longitudinal axis and defining a first plurality of voids between the cutting walls, the outer edges of the cutting walls forming edges of a generally pyramid-shaped volume; and a second portion along the longitudinal axis having a first end abutting the first portion, the second portion comprising a plurality of concave lobes defining a second plurality of voids, the plurality of concave lobes each having a generally concave inner surface that extends radially outward from the longitudinal axis to a concavely curved outer edge.

2. The broadhead of claim 1, wherein respective upper ends of each concavely curved outer edge extend from respective cutting walls.

3. The broadhead of claim 1, wherein the concavely curved outer edges of the plurality of concave lobes comprise rear attack cutting edges and the plurality of cutting walls comprise forward attack cutting edges.

4. The broadhead of claim 1, wherein at least one of the cutting walls includes two radially outer surfaces intersecting at an attack edge and wherein each of the two radially outward surfaces is coplanar with a corresponding radially outer surface of another one of the cutting walls.

5. The broadhead of claim 1, wherein the concavely curved outer edges of the plurality of concave lobes form a wireframe of a portion of a sphere, cone, ellipsoid, or paraboloid.

6. The broadhead of claim 1, wherein one or more of the concave lobes forms a portion of a surface of a sphere, cone, ellipsoid, or paraboloid.

7. The broadhead of claim 1, wherein the first portion and the second portion are a single piece of material.

8. The broadhead of claim 7, wherein the first portion and the second portion are a single piece of material formed using a casting process.

9. The broadhead of claim 1, wherein the first and second pluralities of voids collectively make up about 40% of a volume consisting of the first portion, the second portion, and the first and second pluralities of voids.

10. The broadhead of claim 1, wherein the first and second plurality of voids collectively make up about 57% of a volume consisting of the first portion, the second portion, and the first and second plurality of voids.

11. The broadhead of claim 1, wherein one or more of the concave lobes of the second portion is symmetric about a longitudinal plane.

12. The broadhead of claim 1, wherein one or more of the concave lobes of the second portion is asymmetric.

13. The broadhead of claim 1, wherein one or more of the concave lobes of the second portion is symmetric about a plane with a non-zero angle with the longitudinal axis.

14. The broadhead of claim 1, wherein the plurality of cutting walls comprises three cutting walls.

15. The broadhead of claim 1, wherein one or more of the plurality of cutting walls has a planar surface defining a surface of a respective one of the first plurality of voids, the planar surface being parallel to a radius extending from the longitudinal axis.

16. The broadhead of claim 1, wherein each of the first plurality of voids is substantially shaped as a triangular prism.

17. The broadhead of claim 1, wherein the plurality of cutting walls include triangular planes having respective first points collectively forming a chisel point of the broadhead, a respective second point abutting respective upper ends of an edge of a respective concave lobe to form an attack point, and a respective third point at a transition to an inner portion of the respective concave lobe.

18. The broadhead of claim 1, the concave lobes further comprising generally convex outer surfaces opposite the generally concave inner surfaces and extending radially outward from the longitudinal axis to the concavely curved outer edges.

19. A broadhead comprising:

a plurality of cutting walls extending radially from a longitudinal axis and forming edges of a generally pyramid-shaped volume and defining a first plurality of voids between the cutting walls; and a plurality of concave lobes having generally concave inner surfaces and defining a second plurality of voids, with respective concavely curved edges of the plurality of concave lobes extending between two of the plurality of cutting walls.

20. A broadhead comprising:

a plurality of cutting walls extending from a chisel point and forming edges of a generally pyramid-shaped volume, with the chisel point being a top of the generally pyramid-shaped volume, wherein the plurality of cutting walls define a first plurality of voids between the cutting walls; and a plurality of concave lobes having generally concave inner surfaces and defining a second plurality of voids that are in communication with the first plurality of voids, the plurality of concave lobes having respective concavely curved edges extending between two of the plurality of cutting walls to form respective concavely curved outer edges of the concave lobes.

* * * * *